US007770771B2

(12) United States Patent
Tsai

(10) Patent No.: US 7,770,771 B2
(45) Date of Patent: Aug. 10, 2010

(54) STAPLER WITH ADJUSTABLE FIRING APPARATUS FOR USING STAPLES/NAILS IN VARIOUS SIZES

(75) Inventor: Eric Tsai, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 118 days.

(21) Appl. No.: 12/184,293

(22) Filed: Aug. 1, 2008

(65) Prior Publication Data

US 2009/0127312 A1 May 21, 2009

(30) Foreign Application Priority Data

Nov. 15, 2007 (TW) ..... 96143316 A

(51) Int. Cl.
*B25C 5/11* (2006.01)
*B25C 5/06* (2006.01)

(52) U.S. Cl. ..... 227/109; 227/107; 227/120; 227/139

(58) Field of Classification Search ..... 227/107, 227/109, 110, 114, 117, 118, 120, 123, 139, 227/156

See application file for complete search history.

(56) References Cited

U.S. PATENT DOCUMENTS 3,347,439 A * 10/1967 Doherty ..... 227/109
3,633,811 A * 1/1972 Ploen ..... 227/109
4,556,161 A * 12/1985 Oide ..... 227/83
4,583,276 A * 4/1986 Olesen ..... 29/432.1
5,441,191 A * 8/1995 Linden ..... 227/120
5,639,007 A * 6/1997 Nakamura ..... 227/109
6,196,414 B1 * 3/2001 Ferenczi et al. ..... 221/123
6,851,594 B1 * 2/2005 Huang ..... 227/109
6,871,768 B2 * 3/2005 Adams et al. ..... 227/82
6,974,067 B2 * 12/2005 Chen ..... 227/120
7,044,349 B2 * 5/2006 Adams et al. ..... 227/82
7,562,801 B2 * 7/2009 Pelletier et al. ..... 227/156
2007/0039994 A1 * 2/2007 Pelletier et al. ..... 227/132
2007/0199969 A1 * 8/2007 Pozzato ..... 227/8

FOREIGN PATENT DOCUMENTS

WO WO2005/102613 A1 11/2005

* cited by examiner

*Primary Examiner*—Paul R Durand
(74) *Attorney, Agent, or Firm*—Alan Kamrath; Kamrath & Associates PA

(57) ABSTRACT

A stapler includes an adjustable firing apparatus for using staples/nails in various sizes that simplifies operation of switching between different staples/nails. The adjustable firing apparatus of the stapler includes an adjusting mechanism and a rotation engaged member having first and second engaged portions. An actuating mechanism can be used to adjust the distance between the adjusting mechanism and the front of a magazine assembly of the stapler to be adapted to use staples/nails in various sizes.

13 Claims, 9 Drawing Sheets

STAPLER WITH ADJUSTABLE FIRING APPARATUS FOR USING STAPLES/NAILS IN VARIOUS SIZES

BACKGROUND OF THE INVENTION

1. Field of the Invention

The present invention relates to a stapler. In particular, the stapler includes an adjustable firing apparatus for using staples/nails in various sizes.

2. Description of the Related Art

As disclosed in PCT Publication No. WO2005/102613 A1, a stapler includes a main body which includes a seat for a row of staples and/or nails which are urged by a pusher towards an ejection head. A striker can run in a direction substantially perpendicular to the feed direction of the row of staples and/or nails in the seat for pushing and ejecting from the ejection head the first staple and/or nail of the row. A mobile plate is mechanically connected to a slider by a pin that is housed in corresponding holes made in the mobile plate and in a slider which protrudes outside the main body. Thus, by moving the slider, the mobile plate can slide in the main body for being arranged between the ejection head and the striker when the latter pushes the first staple and/or nail.

Said slider comprises a particular locking mechanism which prevents the accidental sliding of the mobile plate.

According to the above, for using several kinds of staplers and nails with the stapler, a user should operate the slider to drive the mobile plate to slide relative to the main body to adjust the space between the pusher and the ejection head for using various kinds of staples and/or nails. Next, the locking mechanism is operated to fix the position of the slider, which may lead to low working efficiency.

The present invention is therefore intended to obviate or at least alleviate the problems encountered in the prior art.

SUMMARY OF THE INVENTION

According to the present invention, a stapler includes an adjustable firing apparatus for using staples/nails in various sizes that simplifies operation of switching between different staples/nails. The adjustable firing apparatus of the stapler includes an adjusting means, a rotation engaged member having first and second engaged portions and an actuating means. The actuating means is operated to press the adjusting means to adjust the distance between the adjusting means and the front of a magazine assembly of the stapler to be adapted to use staples/nails in various sizes.

In one aspect of the prevent invention, it is easy and simple to adjust the distance between the adjusting means and the front of the magazine assembly by operating the actuating means.

In another aspect of the prevent invention, the stapler is adapted to use four kinds of staples/nails.

In yet another aspect of the prevent invention, the rotation engaged member is made by punching to reduce cost of manufacturing thereof.

Other advantages, objectives and features of the present invention will become apparent from the following description referring to the attached drawings.

BRIEF DESCRIPTION OF THE DRAWINGS

The detailed description and technical characteristics of the present invention are described together with the drawings as follows.

DETAILED DESCRIPTION OF THE PREFERRED EMBODIMENT

Figure 1:
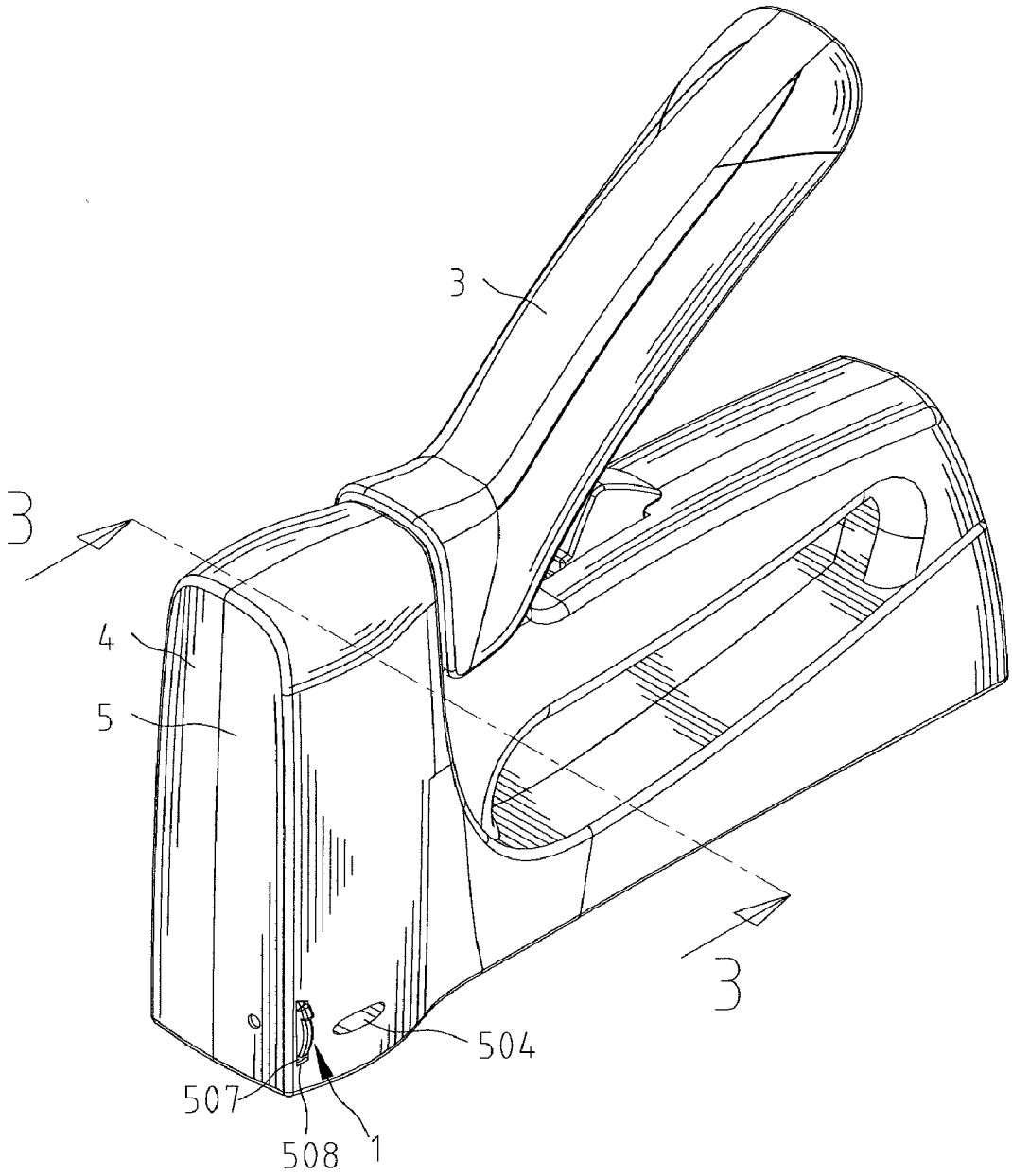
FIG. 1 is a perspective view of a stapler in accordance with the preferred embodiment of the present invention.
Figure 2:
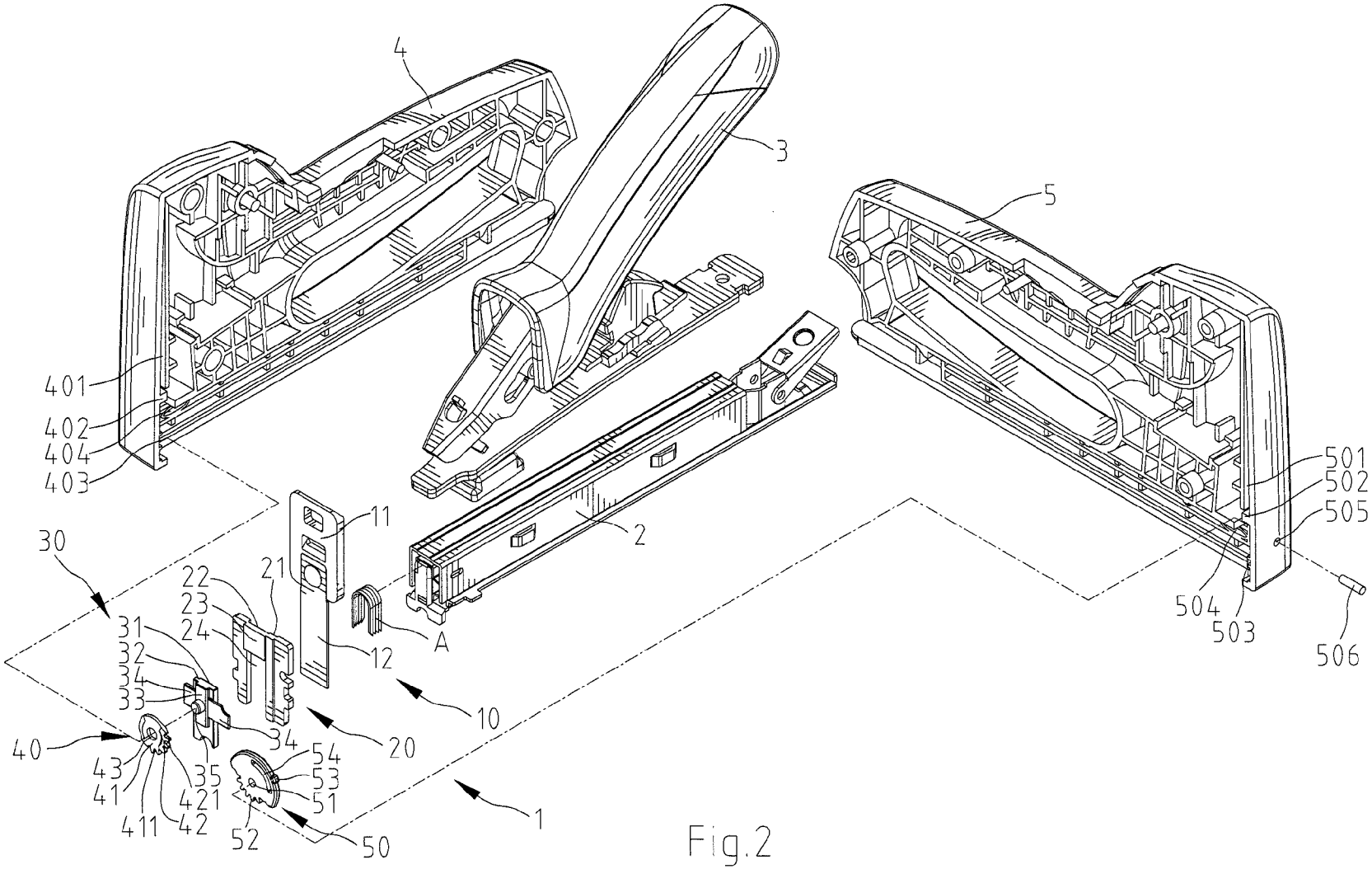
FIG. 2 is an exploded view of the stapler in FIG. 1.
Figure 3:
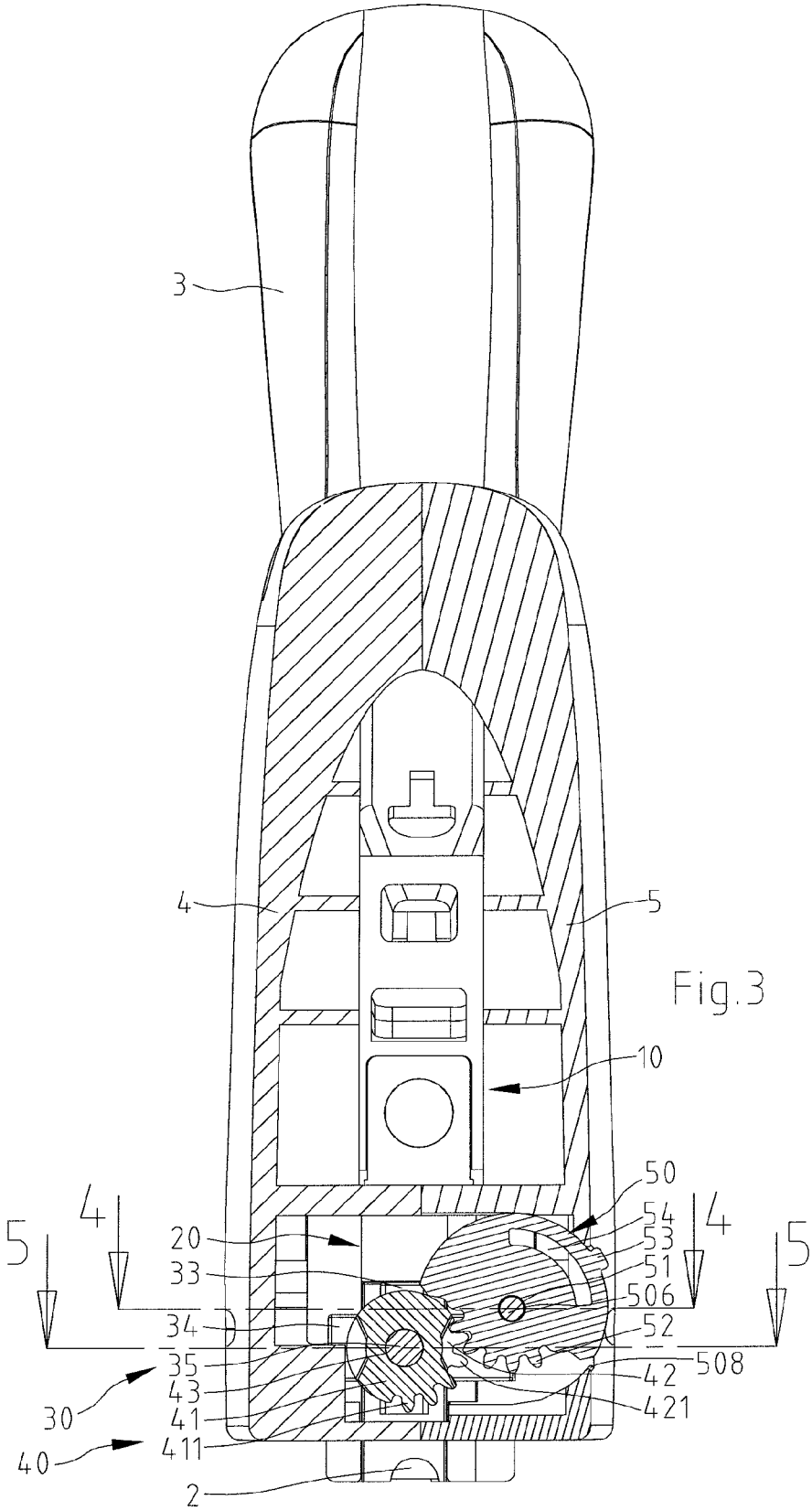
FIG. 3 is a cross-sectional view taken along 3-3 in FIG. 1, illustrating the actuating means engaged with the rotation engaged member.

An embodiment of the present invention will now be discussed with reference to FIGS. 1 through 9. As shown in FIGS. 1 through 3, a stapler includes an adjustable firing apparatus 1, a magazine assembly 2, a handle assembly 3 and first and second shell members 4 and 5. The first and second shell members 4 and 5 are combined to each other to form a main structure of the stapler. The magazine assembly 2 is disposed in the bottom of the first and second shell members 4 and 5. The handle assembly 3 is pivotally installed to the first and second shell members 4 and 5. The adjustable firing apparatus 1 is provided in the front of the first and second shell members 4 and 5, and a user can operate the handle assembly 3 to drive the adjustable firing apparatus 1 for firing staples/nails that are disposed in the magazine assembly 2.

Plunger ledges 401 and 501 are defined on the first and second shell members 4 and 5, respectively, and relative to the adjustable firing apparatus 1. Abutted portions 402 and 502 respectively protrude on the bottom of the plunger ledges 401 and 501 toward the interior of the stapler and correspond to each other. Receiving portions 403 and 503 are defined adjacent to the front of the first and second shell members 4 and 5, respectively, and correspond to each other. The receiving portions 403 and 503 are provided below the plunger ledges 401 and 501, respectively. Peep holes 404 and 504 respectively pierce through the side wall of the first and second shell members 4 and 5, and a user can observe the amount of staples/nails in the magazine assembly 2 via the peep holes 404 and 504. A through-hole 505 is provided on the front of the second shell member 5 adjacent to the receiving portion 503 and adapted for a pin 506 to be inserted therethrough. An actuating means hole 507 and a protrusion 508 are defined on the side wall of the second shell member 5 adjacent to the peep hole 504, with the actuating means hole 507 being long and narrow, and with the protrusion 508 being formed in the bottom of the actuating means hole 507.

The adjustable firing apparatus 1 includes a plunger member 10 disposed in the plunger ledges 401 and 501, a driving member 20 abutting the abutted portions 402 and 502, an adjusting means 30, a rotation engaged member 40 and an actuating means 50. The position of the actuating means 50 in the stapler is limited by the pin 506. The position of the adjusting means 30 in the stapler is limited by the receiving portions 403 and 503.

The plunger member 10 includes a connected portion 11 formed on an end thereof and a firing portion 12 formed on another end thereof opposite to the connected portion 11. The connected portion 11 is connected to an end of the handle assembly 3. While firing staples/nails, the user operates the handle assembly 3, and, then, the firing portion 12 is driven to fall down stably to fire staples/nails.

The driving member 20 has a first surface and a second surface. A first concavity 21 is defined on the first surface of the driving member 20. The firing portion 12 slides along the first surface of the driving member 20. A second concavity 22 is formed on the first concavity 21, so that the first concavity 21 is stepped. Protruding from the second surface of the driving member 20 is a protruding portion 23 that abuts against the abutted portions 402 and 502 respectively. A space 24 pierces through the center of the driving member 20 and is open to the bottom of the driving member 20.

The adjusting means 30 includes a main body 31 having a first surface and a second surface and disposed in the space 24 of the driving member 20. The first surface of the main body 31 is stepped and has a gap 32 formed on a side thereof. A first plate 33 is provided on the second surface of the main body 31, and a second plate 34 is inserted through the first plate 33. The direction of the axis of the first plate 33 is perpendicular to that of the second plate 34, with the distance between the top of the first plate 33 and the second side of the adjusting means 30 being larger than the distance between the top of the second plate 34 and the second side of the adjusting means 30. The second plate 34 is against the second surface of the driving member 20. A pivot 35 is inserted through the center of the first and second plates 33 and 34.

The rotation engaged member 40 is in a form of an uneven piece and includes a first engaged portion 41 and a second engaged portion 42 defined on two sides of the first engaged portion 41 by punching. The thickness of the first engaged portion 41 is greater than that of the second engaged portion 42. Teeth 411 are formed on the periphery of the first engaged portion 41, and teeth 421 are formed on the periphery of the second engaged portion 42, with the teeth 411 being adjacent to and not overlapping the teeth 421. A through-hole 43 is provided on the center of the rotation engaged member 40, and the pivot 35 of the adjusting means 30 is inserted through the through-hole 43. Thus, the rotation engaged member 40 is allowed to rotate relative to the adjusting means 30, with the position of the rotation engaged member 40 in the stapler limited by the receiving portions 403 and 503. Moreover, the first plate 33 of the adjusting means 30 is selectively engaged with one of the first engaged portion 41 and the second engaged portion 42.

The actuating means 50 is in a form of a semi-circle with teeth 52 that extend from the periphery of the flat portion thereof outwardly. A through-hole 51 is defined thereon adjacent to the teeth 52, and a positioned portion 53 is provided on the periphery opposite to the teeth 52. An arc slot 54 is defined along the periphery of the actuating means 50 relative to the positioned portion 53 for increasing the resilience of the periphery of the actuating means 50. The through-hole 51 corresponds to the through-hole 505 so that the pin 506 is inserted through the through-hole 505 and the through-hole 51 in sequence for fixing the actuating means 50 in the second shell member 5. The teeth 52 of the actuating means 50 are selectively engaged with one of the teeth 411 and the teeth 421. The thickness of the positioned portion 53 exactly fits the width of the actuating means hole 507 so that the positioned portion 53 protrudes from the actuating means hole 507 for the user to operate the actuating means 50 to pivot relative to the pin 506. Further, when the positioned portion 53 is rotated to abut with the lowest position in the actuating means hole 507, the positioned portion 53 is able to be pressed inwardly and be received in the actuating means hole 507 behind the protrusion 508.

Figure 4:
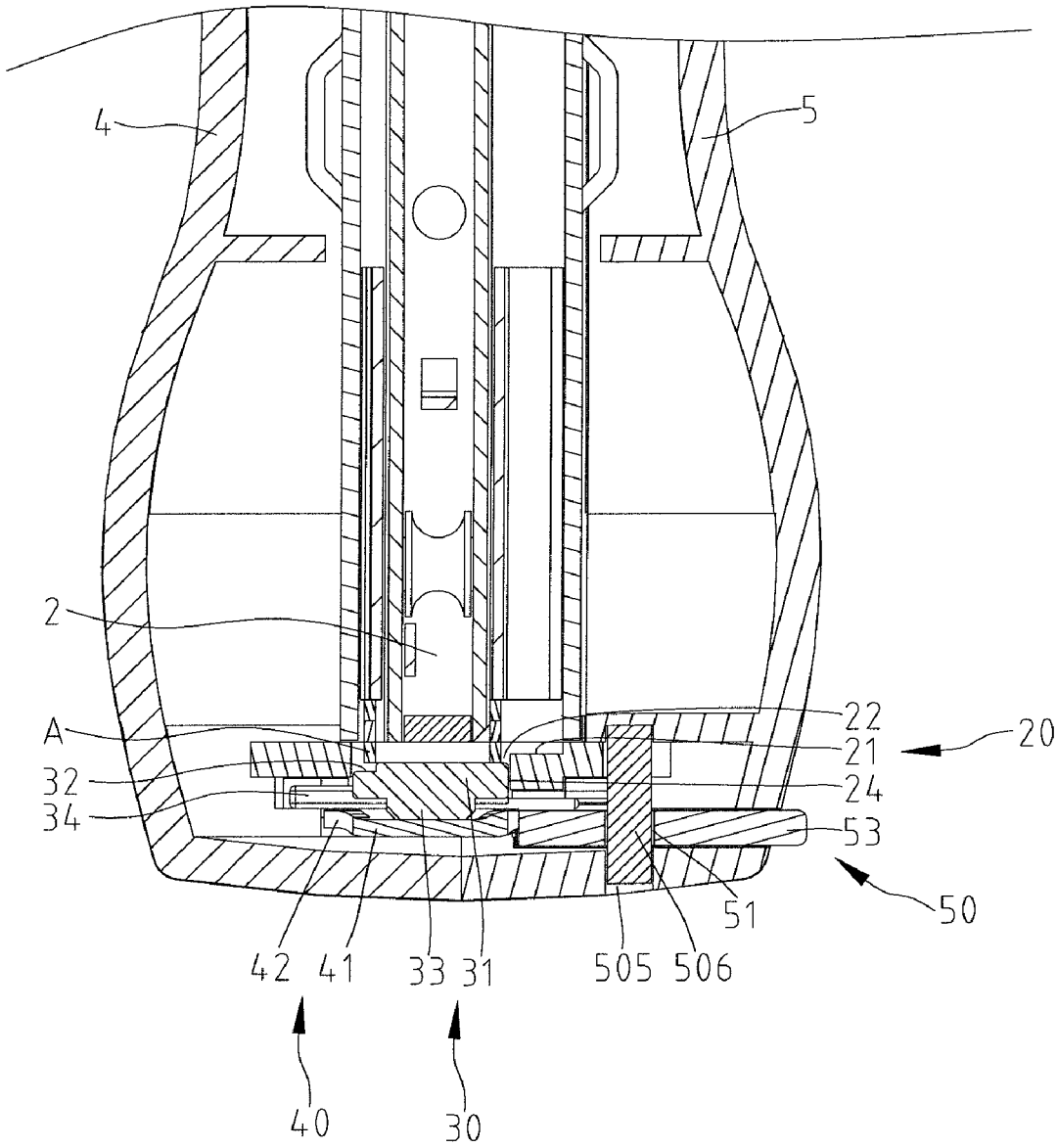
FIG. 4 is a cross-sectional view taken along 4-4 in FIG. 3, illustrating the stapler being used with the first staple.
Figure 5:
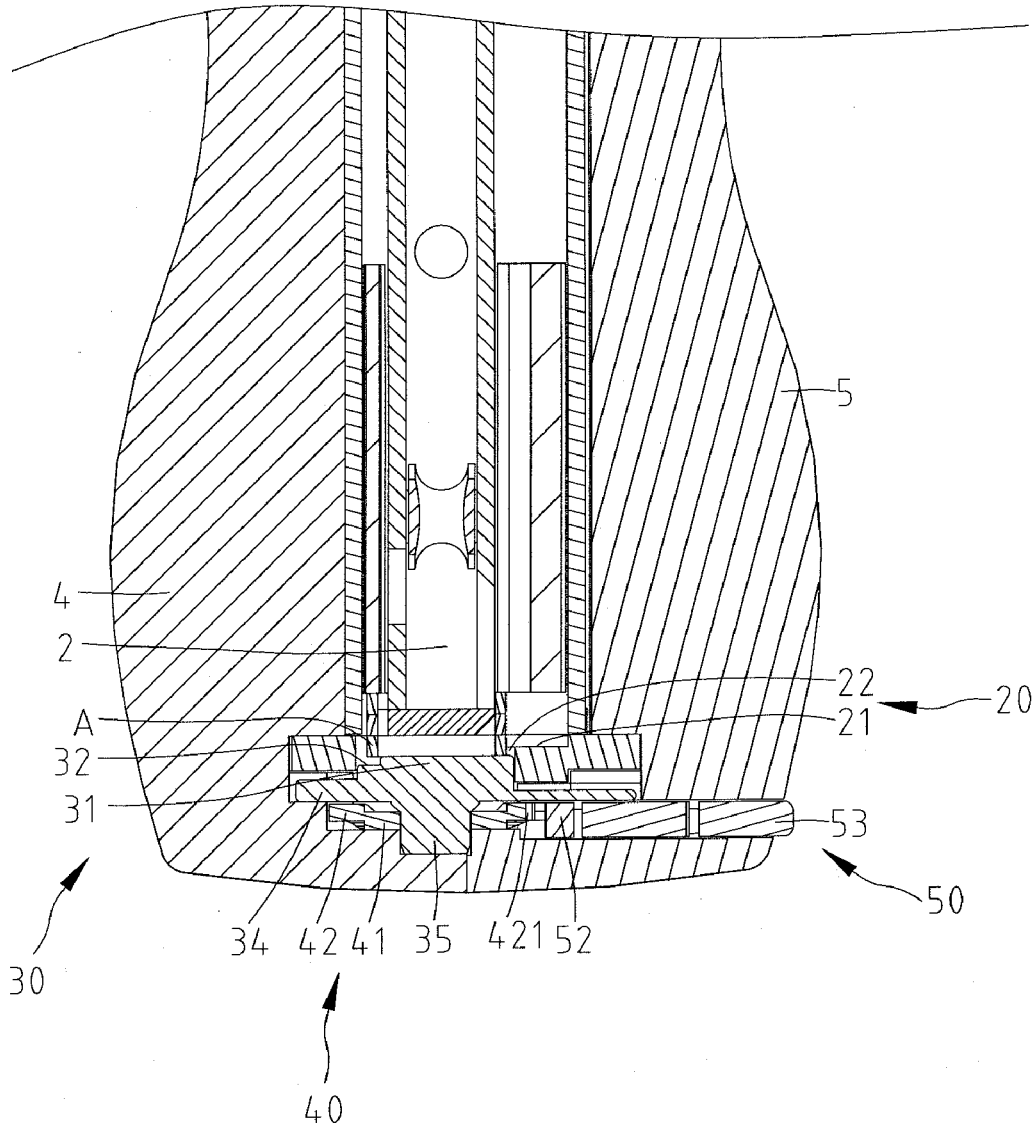
FIG. 5 is a cross-sectional view taken along 5-5 in FIG. 5, illustrating the stapler being used with the first staple.

Referring to FIGS. 3 through 5, the first engaged portion 41 of the rotation engaged member 40 is against the adjusting means 30. The positioned portion 53 is operated to rotate to engage the teeth 52 of the actuating means 50 with the teeth 421 of the second engaged portion 42, and, then, the first engaged portion 41 is adapted to be against the first plate 33 of the adjusting means 30. Simultaneously, the second engaged portion 42 abuts with the second plate 34 of the adjusting means 30 for adjusting the distance between the first surface of the adjusting means 30 and the front of the magazine assembly 2 to be the maximum to receive one of a row of first staples A in the second concavity 22 of the driving member 20. The first surface of the main body 31 abuts the first one of a row of first staples A, with each first staple A being U-shaped.

Figure 6:
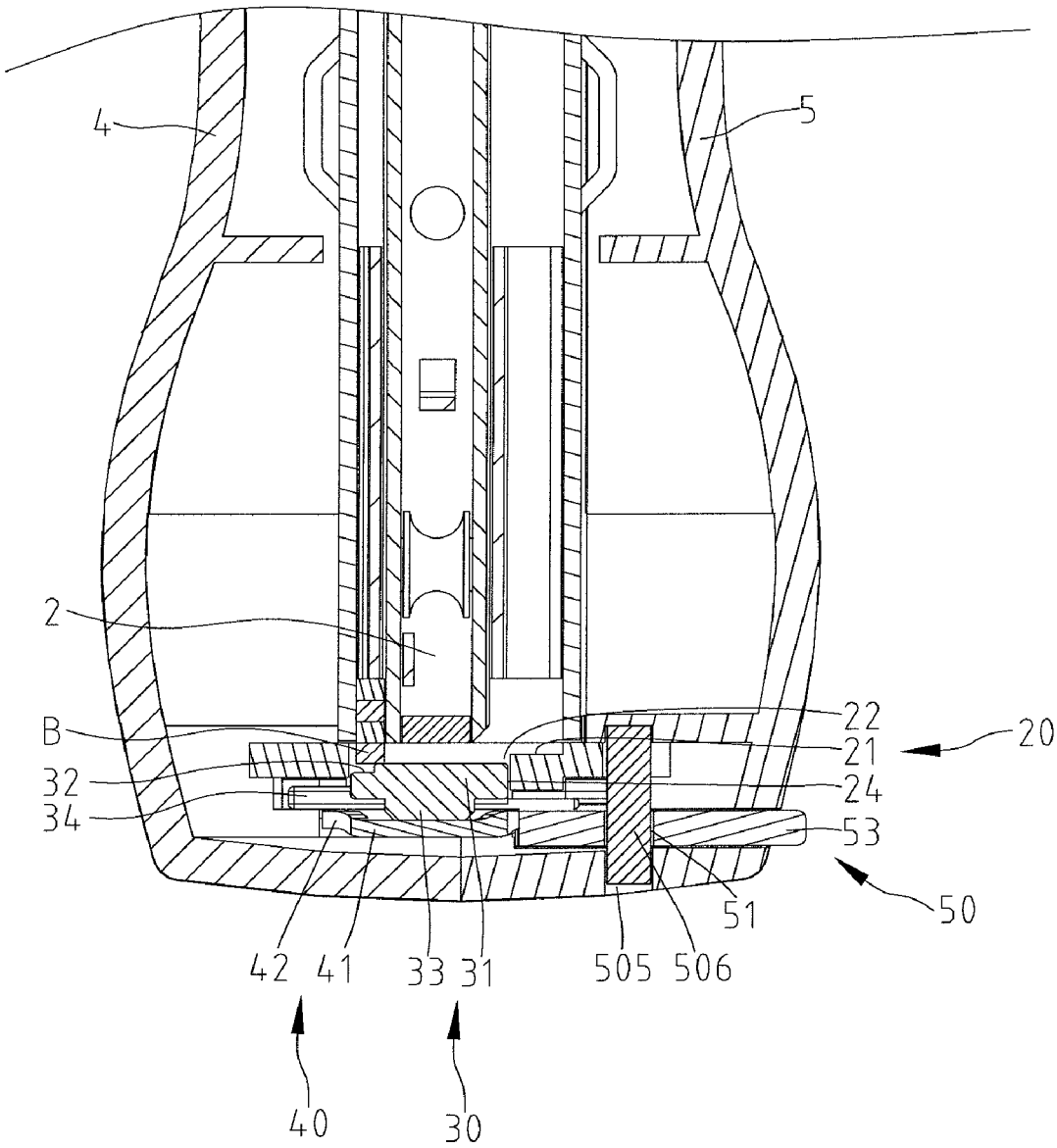
FIG. 6 is a cross-sectional view similar to FIG. 4, but illustrating the stapler being used with the nail with head.

Referring to FIG. 6, while the distance between the first surface of the adjusting means 30 and the front of the magazine assembly 2 is at the maximum, one of a row of nails with a head B is also adapted to be received in the second concavity 22 of the driving member 20. The first surface of the main body 31 abuts the first the one of a row of nails with the head B, with each nail with the head B being T-shaped.

Figure 7:
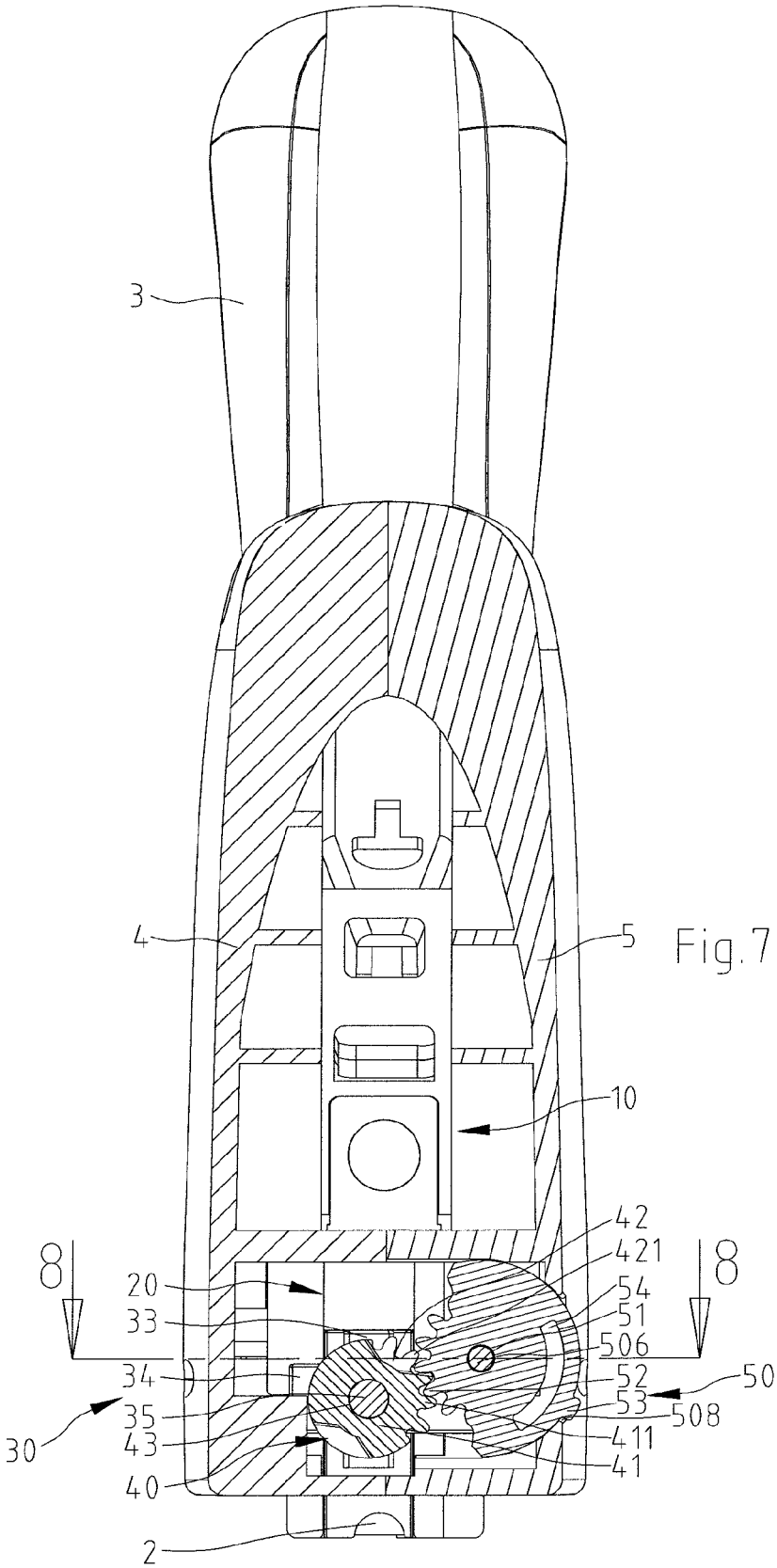
FIG. 7 is a cross-sectional view similar to FIG. 3, but illustrating the actuating means being operated to rotate clockwise.
Figure 8:
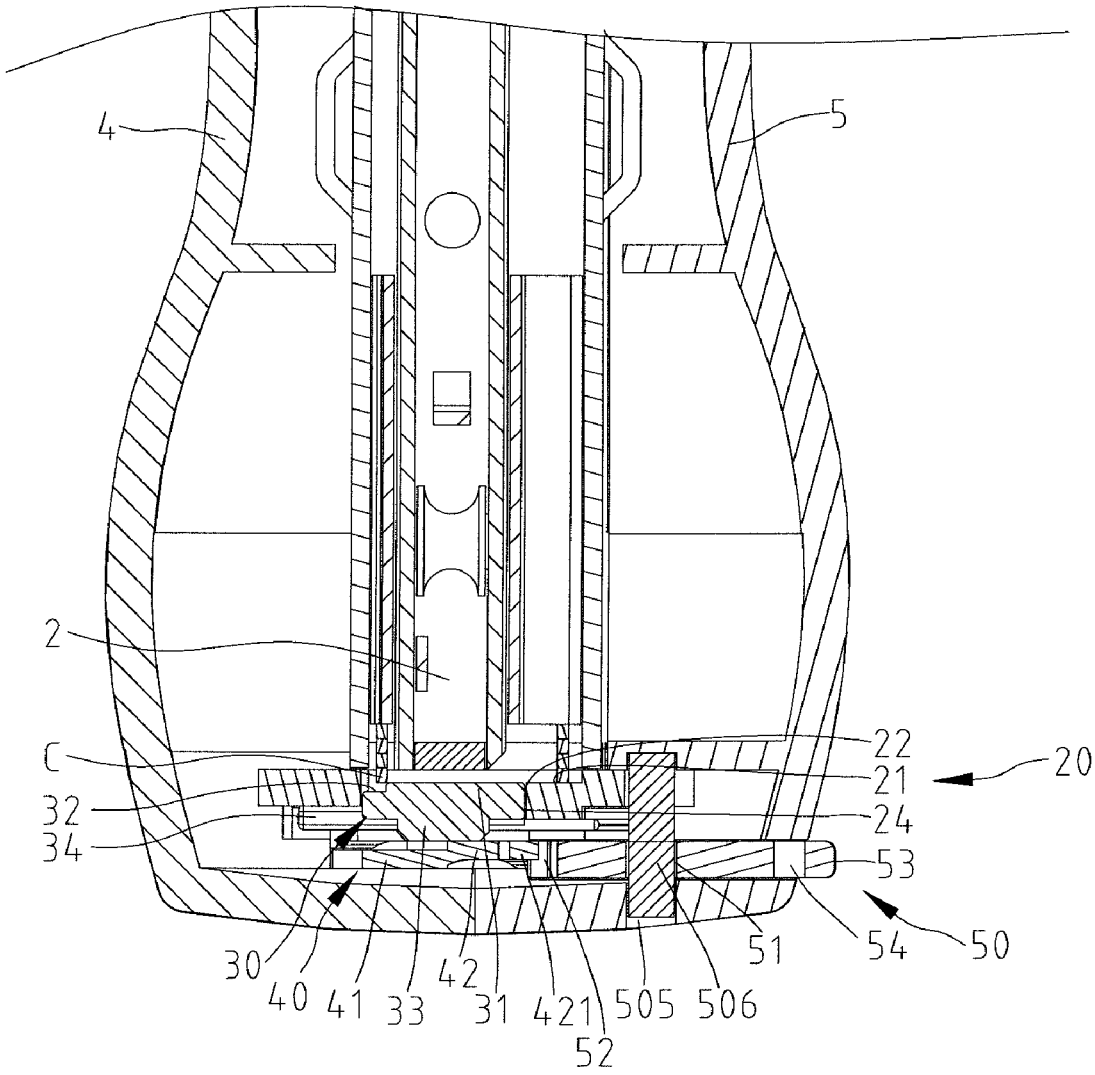
FIG. 8 is a cross-sectional view taken along 8-8 in FIG. 7, illustrating the stapler being used with the second staple.

Referring to FIGS. 7 and 8, the second engaged portion 42 of the rotation engaged member 40 is against the adjusting means 30. The positioned portion 53 is operated to rotate to engage the teeth 52 of the actuating means 50 with the teeth 411 of the first engaged portion 41, and, then, the second engaged portion 42 is adapted to be against the first plate 33 of the adjusting means 30. Simultaneously, the main body 31 of the adjusting means 30 is pressed toward the space 24 of the driving member 20 to adjust the distance between the first surface of the adjusting means 30 and the front of the magazine assembly 2 to be the minimum to receive one of a row of second staples C in the second concavity 22 of the driving member 20. The first surface of the main body 31 abuts the first one of a row of second staples C, with each second staple C being U-shaped similar to the first staple A. However, the thickness of the cross-section of each second staple C is thinner than that of each first staple A, and the width of the staple boot of each second staple C is greater than that of each first staple A so that one of staple boot of each second staple C is disposed in the first concavity 21.

Figure 9:
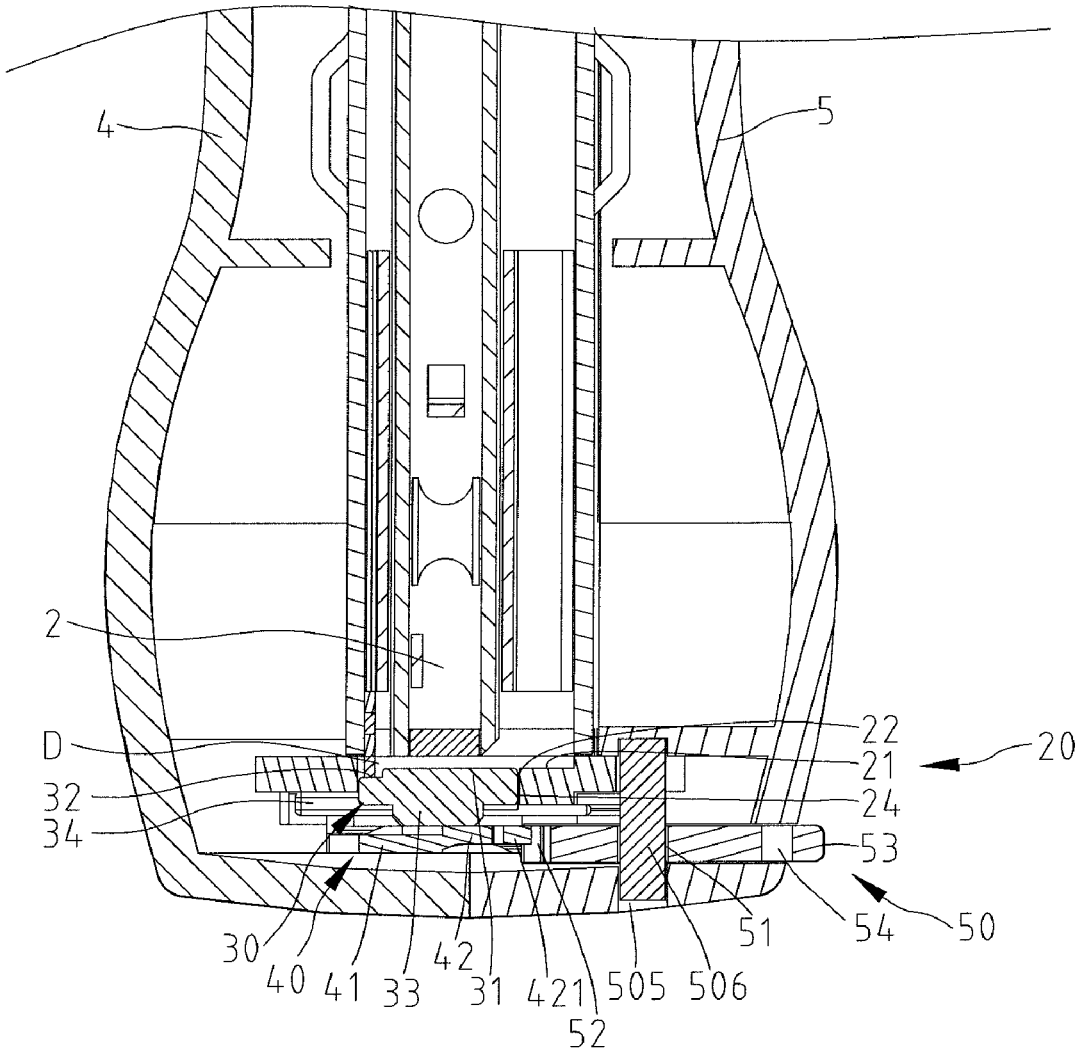
FIG. 9 is a cross-sectional view similar to FIG. 8, but illustrating the stapler being used with the nail without a head.

Referring to FIG. 9, while the distance between the first surface of the adjusting means 30 and the front of the magazine assembly 2 is being the minimum, one of a row of nails without a head D is adapted to be received in the gap 32 of the adjusting means 30.

What is claimed is:

1. A stapler comprising: a main structure including a first shell member and a second shell member, a magazine assembly disposed in the main structure, a handle assembly pivotally installed to the main structure, an adjustable firing apparatus;

wherein the adjustable firing apparatus comprises:

a plunger member connected to an end of the handle assembly;

a driving member including a first concavity, a second concavity formed on the first concavity and a space piercing therethrough, with the plunger member slideable along the first concavity;

an adjusting means selectively received in the space of the driving member; and a rotation engaged member rotatably mounted on the adjusting means opposite to the driving member and including a first engaged portion and a second engaged portion, with the adjusting means selectively abutted with one of the first and second engaged portions to adjust the distance between the adjusting means and the magazine assembly for using staples/nails in various sizes, and an actuating means pivotally installed on the main structure and including a positioned portion protruding therefrom, with teeth formed on the actuating means opposite to the positioned portion and engaged with one of the first and second engaged portions of the rotation engaged member selectively.

2. The stapler as claimed in claim 1, with the second engaged portion defined on two sides of the first engaged portion by punching, with the thickness of the first engaged portion being greater than that of the second engaged portion, with teeth formed on the periphery of the first engaged portion for engaging with teeth of the actuating means, with teeth formed on the periphery of the second engaged portion for engaging with teeth of the actuating means, with the teeth of the first engaged portion being adjacent to and not overlapping the teeth of the second engaged portion.

3. The stapler as claimed in claim 1, with the adjusting means including a main body having a first surface and a second surface and disposed in the space of the driving member, with the first surface of the main body being stepped; wherein a first plate is provided on the second surface of the main body, and a second plate is inserted through the first plate, with the direction of an axis of the first plate being perpendicular to that of the second plate, with the distance between the top of the first plate and the second side of the adjusting means being larger than the distance between the top of the second plate and the second side of the adjusting means, with the second plate being against the second surface of the driving member.

4. The stapler as claimed in claim 1, with the actuating means being a semi-circle, with the teeth of the actuating means extending from the periphery of the actuating means outwardly, with the positioned portion provided on the periphery of the actuating means opposite to the teeth.

5. The stapler as claimed in claim 1, further comprising plunger ledges defined on the first and second shell members, respectively, for receiving the plunger member, abutted portions respectively protruding on the bottom of the plunger ledges toward the interior of the stapler and abutting the driving member, and receiving portions defined adjacent to the front of the first and second shell members, respectively; wherein positioning of the adjusting means in the stapler is limited by the receiving portions.

6. The stapler as claimed in claim 5, further comprising an actuating means hole and a protrusion defined on the side wall of the second shell member, with the positioned portion protruding from the actuating means hole for a user to operate the actuating means.

7. The stapler as claimed in claim 5, further comprising a through-hole provided on the front of the second shell member adjacent to the receiving portion and adapted for a pin to be inserted therethrough; wherein positioning of the rotation engaged member and the actuating means in the stapler is limited by the pin.

8. The stapler as claimed in claim 1, further comprising peep holes respectively pierce through side wall of the first and second shell members for observing amount of staples/nails in the magazine assembly.

9. A stapler comprising: a main structure including a first shell member and a second shell member, a magazine assembly disposed in the main structure, a handle assembly pivotally installed to the main structure and an adjustable firing apparatus;

wherein the adjustable firing apparatus further comprises:

a plunger member connected to an end of the handle assembly;

a driving member including a first concavity, a second concavity formed on the first concavity and a space piercing therethrough, with the plunger member slideable along the first concavity;

an adjusting means selectively received in the space of the driving member; and a rotation engaged member rotatable mounted on the adjusting means opposite to the driving member and including a first engaged portion and a second engaged portion, with the adjusting means selectively abutted with one of the first and second engaged portions to adjust the distance between the adjusting means and the magazine assembly for using staples/nails in various sizes, with the adjusting means including a main body having a first surface and a second surface and disposed in the space of the driving member, with the first surface of the main body being stepped; wherein a first plate is provided on the second surface of the main body, and a second plate is inserted through the first plate, with the direction of an axis of the first plate being perpendicular to that of the second plate, with the distance between the top of the first plate and the second side of the adjusting means being larger than the distance between the top of the second plate and the second side of the adjusting means, with the second plate being against the second surface of the driving member.

10. The stapler as claimed in claim 9, further comprising a pivot inserted through the center of the first and second plates, with the rotation engaged member rotatably mounted on the pivot.

11. The stapler as claimed in claim 10, further comprising a through-hole formed on the center of the rotation engaged member, with the pivot inserted through the through-hole.

12. The stapler as claimed in claim 9, further comprising a gap formed on a side of the main body so as to form the first surface of the main body to be stepped.

13. A stapler comprising: a main structure includes a first shell member and a second shell member, a magazine assembly disposed in the main structure, a handle assembly pivotally installed to the main structure, and an adjustable firing apparatus;

wherein the adjustable firing apparatus further comprises:

a plunger member connected to an end of the handle assembly;

a driving member including a first concavity, a second concavity formed on the first concavity and a space piercing therethrough, with the plunger member slideable along the first concavity;

an adjusting means selectively received in the space of the driving member; and a rotation engaged member rotatably mounted on the adjusting means opposite to the driving member and including a first engaged portion and a second engaged portion, with the adjusting means selectively abutted with one of the first and second engaged portions to adjust the distance between the adjusting means and the magazine assembly for using staples/nails in various sizes, with the plunger member including a connected portion connected to the handle assembly and a firing portion driven to fall down stably to fire staples/nails.

* * * * *